US005624052A

United States Patent [19]

Caldi

[11] Patent Number: 5,624,052

[45] Date of Patent: Apr. 29, 1997

[54] REFRESHMENT HOLDER WITH HANDLE

[76] Inventor: Michel Caldi, 9 chemin de l'Aunay, 78550 Bazainville, France

[21] Appl. No.: 351,342

[22] PCT Filed: Jun. 10, 1993

[86] PCT No.: PCT/FR93/00554

§ 371 Date: Dec. 9, 1994

§ 102(e) Date: Dec. 9, 1994

[87] PCT Pub. No.: WO93/25127

PCT Pub. Date: Dec. 23, 1993

[30] Foreign Application Priority Data

| | | | |
|---|---|---|---|
| Jun. 10, 1992 | [FR] | France | 92 06994 |
| Dec. 9, 1992 | [FR] | France | 92 14848 |
| Dec. 9, 1992 | [FR] | France | 92 14849 |

[51] Int. Cl.[6] ..... A47G 19/06

[52] U.S. Cl. ..... 220/575; 206/549; 220/23.83; 220/507; 294/143; 294/159

[58] Field of Search ..... 229/932; 220/507, 220/575, 4.31, 23.88, 629, 408, 410, 903; 206/541, 546, 549; 215/393; 294/143, 146, 159

[56] References Cited

U.S. PATENT DOCUMENTS

| | | | |
|---|---|---|---|
| 1,595,356 | 8/1926 | Moseman . | |
| 2,101,401 | 12/1937 | Leppke | 220/23.83 |
| 2,107,381 | 2/1938 | Leppke | 220/23.83 |
| 2,240,020 | 4/1941 | Raiser . | |
| 2,561,022 | 7/1951 | Jones . | |
| 2,661,679 | 12/1953 | Van Guider | 220/408 X |
| 2,920,804 | 1/1960 | Minton . | |
| 3,027,037 | 3/1962 | Bronson . | |
| 3,384,260 | 5/1968 | Buffington | 220/23.83 X |
| 4,607,758 | 8/1986 | Stevens . | |
| 4,732,274 | 3/1988 | Bouton . | |
| 4,742,951 | 5/1988 | Kelly et al. | 220/410 X |
| 4,848,579 | 7/1989 | Barnes et al. | 220/23.83 X |
| 4,867,331 | 9/1989 | Task . | |
| 5,060,820 | 10/1991 | Boerner . | |
| 5,085,391 | 2/1992 | Berger et al. | 220/23.83 X |
| 5,207,743 | 5/1993 | Costarella et al. | 220/25.83 X |
| 5,346,070 | 9/1994 | McSpadden | 220/575 X |

FOREIGN PATENT DOCUMENTS

| | | |
|---|---|---|
| 0106626 | 4/1984 | European Pat. Off. . |
| 1471281 | 3/1967 | France . |
| 2532833 | 3/1984 | France . |
| 2592571 | 7/1987 | France . |
| 906502 | 3/1954 | Germany . |
| 3313369 | 12/1983 | Germany . |
| 3615933 | 11/1987 | Germany . |
| 9216491 | 6/1993 | Germany . |
| 1377826 | 12/1974 | United Kingdom . |
| 2023407 | 3/1980 | United Kingdom . |
| WO92/05079 | 2/1992 | WIPO . |

*Primary Examiner*—Allan N. Shoap
*Assistant Examiner*—Robin A. Hylton
*Attorney, Agent, or Firm*—Bacon & Thomas

[57] ABSTRACT

A refreshment holder with a handle and a food receptacle or receptacles surrounding or adjacent the handle with room provided to enable the handle to be grasped. The bottom of the receptacle is substantially in the same plane as the bottom end of the handle. A beverage container may be accommodated in the handle.

2 Claims, 3 Drawing Sheets

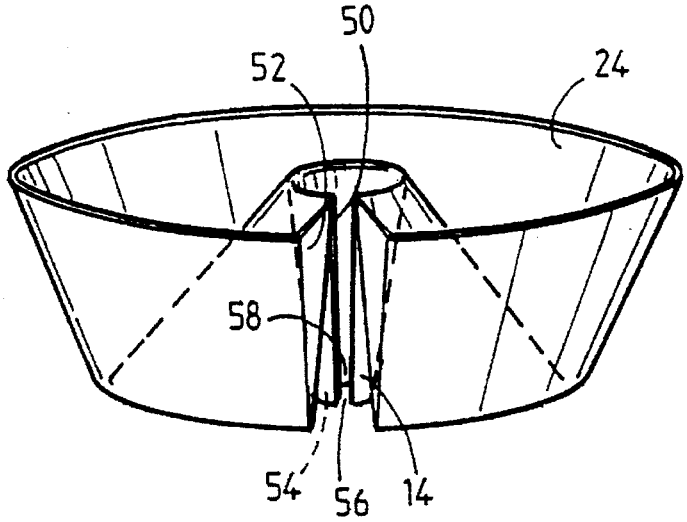
FIG. 6
FIG. 7
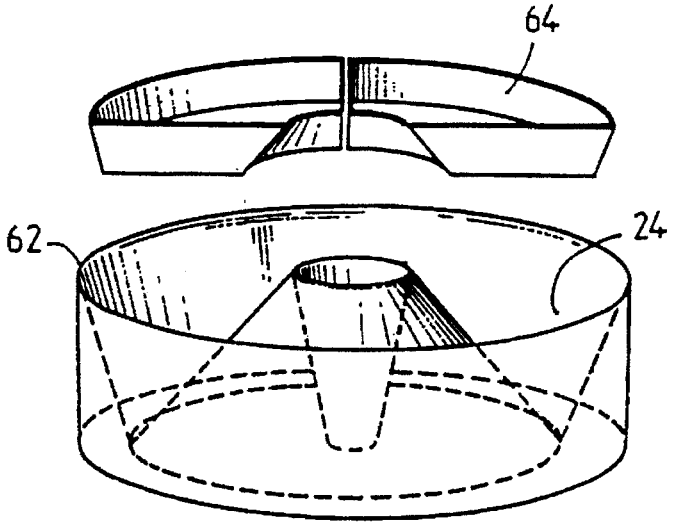
FIG. 8
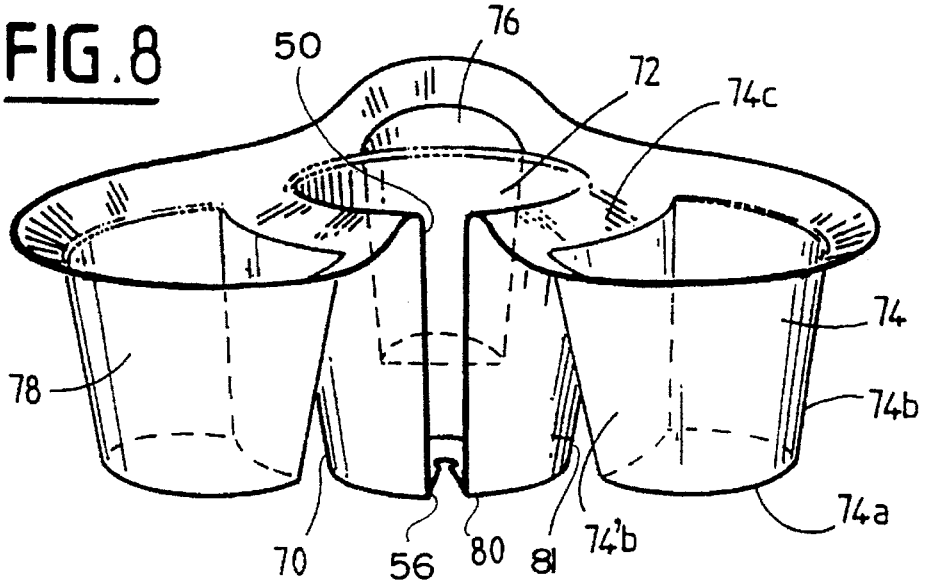

REFRESHMENT HOLDER WITH HANDLE

FIELD OF THE INVENTION

The present invention relates to a refreshment holder with a handle.

More precisely, the invention relates to a device enabling the user to use a single hand to hold preferably a plurality of receptacles containing various food items, and preferably also a glass, while leaving the other hand free to manipulate the utensils required for eating the foods.

Such a device is very useful not only at receptions where guests are not sat down to table, e.g. exhibitions, parties, and buffet lunches, but also in any situation where the user seeks to take food while a table is not available, e.g. in various public places such as railway stations, trains, stadiums, and cinema lines, and also merely while watching television.

The term "receptacle" is used herein to refer to any type of object capable of containing food, regardless of the shape or the material from which it is made, e.g. cardboard plates, small trays, or dishes, said list naturally not being limiting.

The term "glass" is used herein to refer to any type of object capable of containing liquids, regardless of its shape or the material from which it is made, such as: a glass, a beaker, or an ice cream cone, said list naturally being limiting.

BACKGROUND OF THE INVENTION

Various types of receptacle, plate, small tray, or meal tray made of food-grade card or plastic are already in existence on the market. It is true that all of them can contain food, and some of them can be used with a glass or beaker for eating purposes while standing or sitting down without a table.

U.S. Pat. No. 2,561,022 describes such a device made up of a flat-bottomed tray and including a low rim. A frustoconically-shaped handle is provided at the center of the bottom of the tray, serving firstly to enable it to be held as a whole, and secondly providing an internal Cavity suitable for receiving a beaker. However, that device solves the problem only in part insofar as it is suitable only for use with aperitif-type snack foods, and also, since the handle projects down along way from the bottom of the tray, the tray cannot be used while it is standing on a table.

OBJECTS AND SUMMARY OF THE INVENTION

An object of the present invention is to remedy the drawbacks of prior solutions by providing a refreshment holder device that is usable under acceptable conditions of comfort not only when held in the hand, e.g. when its user is in a standing position, but also when supported by a table or any other horizontal surface.

To achieve this object, the refreshment holder of the invention comprises handle means and receptacle-forming means for receiving foods, said handle means including a first end for connecting to the receptacle-forming means and a second end that is free, the distance between the two ends being sufficient to enable the handle means to be grasped in the hand, the receptacle-forming means having a bottom and a side wall, said bottom being connected to said first end of the handle means, a portion of said bottom being substantially in the same plane as the second end of the handle means, the portion of said bottom that connects to the handle means leaving empty space around the handle means to allow the hand of the user to be engaged around the handle means.

It will be understood that the dispositions of the invention make, it is possible to put the device down on a horizontal surface because of the characteristics of its bottom, or else to hold the device conventionally in the hand because a space is provided around the handle means.

The handle means is substantially frustoconical in shape and is hollowed out internally to receive a beaker or a glass or a beverage can.

In a first implementation, the receptacle-forming means have a half-section in an axial plane that flares upwardly, e.g. a U-shaped or a V-shaped or a rectangular-shaped section, with its apex forming the bottom of the receptacle, with one of its branches forming the side wall, and with its other branch forming the portion that connects with the handle means.

In this first embodiment, the receptacle thus constitutes a single unit.

In a second embodiment of the device, the wall forming the bottom of the receptacle-forming means includes projecting portions that extend from the side wall to the connecting portion, whereby the receptacle-forming means comprises a plurality of distinct compartments.

In a third embodiment of the device, the receptacle-forming means comprises a plurality of individual receptacles that are removable from the handle means, each individual receptacle comprising a bottom, a side wall, and means for securing it to said first end of the handle means, said individual receptacle bottoms being disposed substantially in the same plane as the second end of the handle means when said receptacles are secured to said handle means.

It will be understood that with this third embodiment of the invention, it is possible to begin by selecting receptacles as a function of the dishes they initially contain and to secure them one after another to the handle means. After they have been secured in this way, the user has a disposition that complies with the general definition of the invention.

BRIEF DESCRIPTION OF THE DRAWINGS

Other characteristics and advantages of the present invention appear more clearly on reading the following description of various embodiments of the invention given as non-limiting examples. The description refers to the accompanying figures, in which:

FIG. 6 is a perspective view of a second variant of the FIG. 1 embodiment;

FIG. 7 is a perspective view of a third variant of the FIG. 1 embodiment;

FIG. 8 is a perspective view of a second embodiment of the invention, in which a plurality of independent receptacles are to be found;

MORE DETAILED DESCRIPTION

Figure 1:
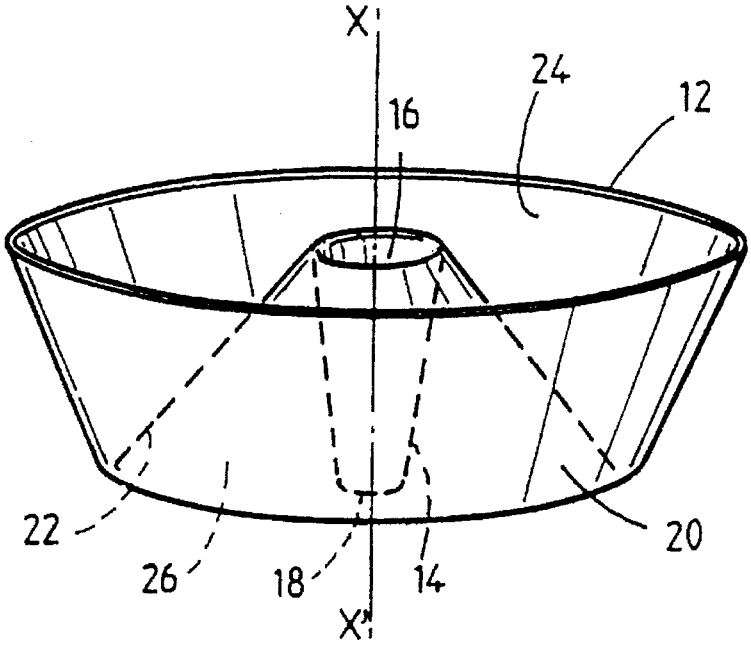
FIG. 1 is a perspective view of a first embodiment of the invention.
Figure 2:
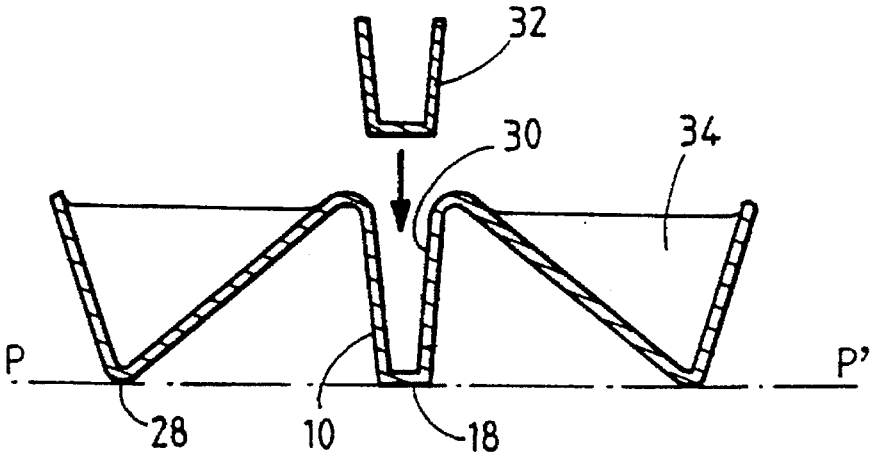
FIG. 2 is a vertical section view through the embodiment of FIG. 1.

With reference initially to FIGS. 1 and 2, there follows a description of a first embodiment of the device of the invention. This comprises handle means 10 and receptacle-forming means 12. In this embodiment, the handle means 10 is constituted by a part 14 in the form of a truncated cone which has an open top end 16 and a closed bottom end 18, the diameter of the top end 16 being greater than the diameter of the bottom end. The receptacle-forming portion is circularly symmetrical about the axis XX' of the part 14 and it has a V-shaped cross-section. More precisely, it is made up of an outer frustoconical side wall 20 and an inner frustoconical wall 22 whose top edge is connected to the top end 16 of the handle-forming means 10. An internal annular volume 24 is thus defined for receiving refreshments or foods, and an external volume 26 is also defined that surrounds the handle part 14 thus making it easy to hold. As can be seen more clearly in FIG. 2, the bottom end 18 of the handle means 10 and the apex of the V-section 28 lie substantially in the same horizontal plane PP', thus enabling the device as a whole to be placed on a horizontal surface. In the embodiment of FIG. 2, the internal cavity 30 of the handle means 10 is of dimensions capable of receiving a glass 32. In FIG. 2, there can also be seen radial partitions 34 thus enabling different compartments to be defined in the receptacle. These partitions are preferably hollow so as to enable a plurality of devices to be stacked one in another.

Figure 3:
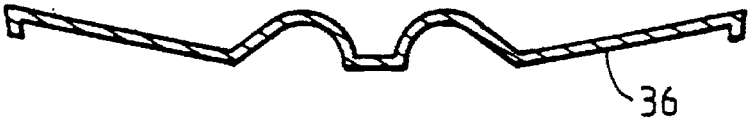
FIG. 3 is a section through a cover suitable for fitting to the device of FIG. 1.

FIG. 3 shows a cover 36 that can be placed on the receptacle-forming means.

Figure 4:
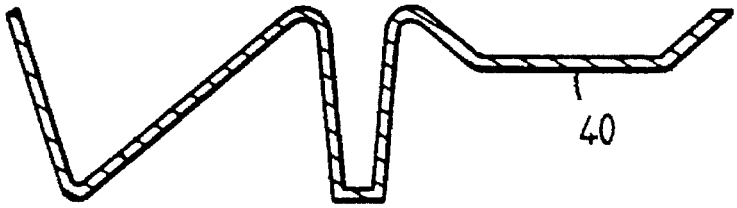
FIG. 4 is a vertical section through a first variant of the FIG. 1 embodiment.

FIG. 4 shows a first variant of the embodiment of FIG. 1 in which a radial recess 40 is provided in the receptacle-forming portion, making it possible, if necessary, to pass the wrist of the user of the meal-taking device.

Figure 5:
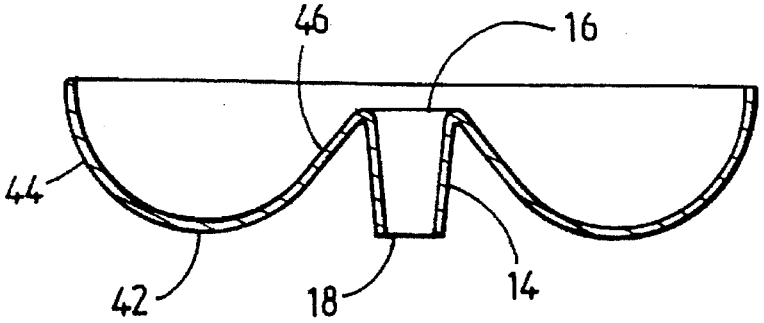
FIG. 5 is a vertical section through a variant of the FIG. 1 embodiment.

FIG. 5 shows a second variant in which the handle means 10 are still in the form of a truncated cone, but the bottom end is open. The receptacle-forming means are still annular in shape, but they now have a right half-section that is substantially U-shaped, with the apex 42 of the U-shape that forms the bottom of the receptacle being disposed substantially in the same plane as the end 18 of the handle means, one of the branches 44 forming the side wall, and the other branch 46 forming a portion for connecting to the top end of the handle means. The right half-section could equally well be rectangular.

FIG. 6 shows a third variant of the FIG. 5 device that enables a glass having a stem to be placed in the handle means 14. For this purpose, the frustoconical side wall includes a slot 50 extending between its two ends. This slot 50 is extended by an opening 52 through the inside volume 24 that is designed to receive food. In addition, the bottom end of the handle means is provided with a partition 54 that includes a radial slot 56 extending the slot 50, and a circular orifice 58 placed on the axis of the truncated cone. It will be understood that this makes it possible to receive a glass having a stem, the bowl portion of the glass resting on the periphery of the top end 16 of the handle means, while the stem is received in the central circular recess 58.

FIG. 7 shows a variant of the handle device in which the meal-taking device further includes individual receptacles such as 64 which may be installed in the inside volume of the receptacle 24. This embodiment thus makes it possible to choose trays 64 corresponding to the food dishes that are desired.

The second embodiment as shown in FIG. 8 differs from the first embodiment in that instead of having a single receptacle designed to receive a plurality of foods, the receptacle-forming means are constituted by a plurality of compartments connected to the handle-forming means. FIG. 8 shows handle-forming means 70 in the form of a truncated cone and similar to that of FIG. 6 insofar as it is suitable for receiving a glass having a stem. The top end 72 of the handle-forming means 70 is connected to the top portion of the three housings designed to receive foods, and given respective references 74, 76, and 78. The number of housings could naturally be different. Each housing, e.g. the housing 74, has a bottom **74*a*, a side wall 74*b*, and a portion 74*c* connecting it to the top end of the handle means. The bottoms of the various compartments 74, 76, and 78 lie substantially in the same plane as the bottom end 80 of the handle means 70. The shape of the portion 74'*b* of the side wall of the compartments is such as to leave a volume 81 around the handle means 70 of sufficient size to enable the handle means 70** to be held easily.

Figure 10:
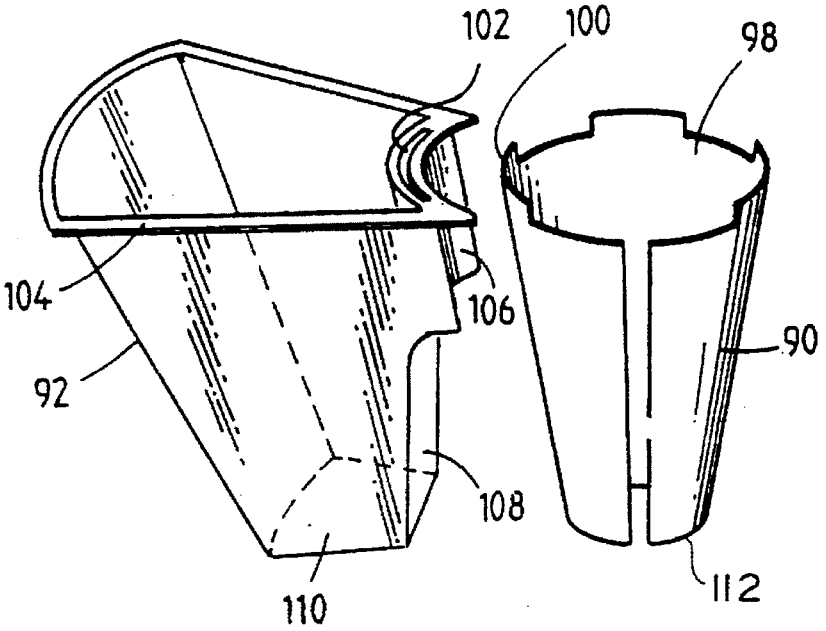
FIG. 10 is a perspective view of the FIG. 9 device showing the handle means and a removable receptacle.
Figure 9:
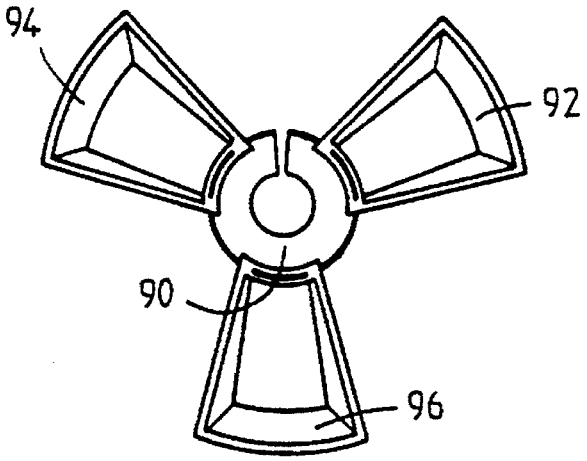
FIG. 9 is a perspective view of the top of a third embodiment of the invention in which the receptacles are removable.

With reference now to FIGS. 9 and 10, a third embodiment of the meal-taking device is described. In this embodiment, there can likewise be found handle means 90 constituting a genuinely frustoconical handle, together with a plurality of removable compartments, three in the case of FIG. 9, referenced 92, 94, and 96. The removable compartments or removable receptacles are mechanically connected to the top end 98 of the handle means 90. To do this, the top edge of the handle means include lugs such as 100 capable of co-operating with slots 102 as formed in the periphery 104 of each compartment, e.g. the compartment 92. In addition, the portion of the side wall of the compartment disposed close to the slot 102 defines a bearing surface 106 that is complementary in shape to the top outside face of the truncated cone constituting the handle 90. Thus, when the lug is engaged in the slot 102, the handle means 90 is secured to the compartment 92, thereby building up a structure analogous to that shown in FIG. 8. As can be seen, the bottom portion of the side wall directed towards the handle means and referenced 108 is set back from the bearing surface 106 so as to enable the bottom portion of the handle means 90 to be grasped. In accordance with the invention, the bottom 110 of each compartment is disposed substantially in the same plane as the bottom end 112 of the handle means once the compartments have been secured to the handle means.

Preferably, the handle-forming means has a disengaged height lying in the range 4 cm to 7 cm so as to make the meal-taking device convenient to grasp.

Also preferably, the device is made of a plastics material or out of a material based on vegetable fibers, e.g. coming from recycled paper. Depending on the material used, the device may be made by injection molding, by molding, or by thermoforming.

I claim:

1. A refreshment holder comprising handle means for grasping in a user's hand and receptacle-forming means for receiving foods, said handle means including a first end for connecting to the receptacle forming means and a second end that is free, the distance between the two ends of said handle means being in the range of 4–7 cm, said receptacle-forming means defining a plurality of separated distinct compartments and being connected to said first end of said handle means and including a bottom portion that lies substantially in the same radially extending plane that includes the second end of the handle means, said handle means occupying a substantially central position and extending along a central axis relative to the receptacle-forming means, said handle means being open at its first end, said receptacle-forming means being spaced from the handle means to permit access by the hand of a user around the handle means; said handle means being in the form of a hollow truncated cone forming an internal housing, said first end of the handle means having a diameter greater than the diameter of said second end; said receptacle-forming means including a radial opening extending to the space that surrounds the handle means for receiving a wrist of a user.

2. A refreshment holder according to claim 1, wherein said handle means includes a side wall between its first and second end adjacent said radial opening in said receptacle-forming means, said side wall having a first slot extending between the first and second end of said handle means for receiving a stem of a stemmed glass to be supported in the opening in said handle means; said handle means being closed by a partition at said second end, said partition including a second slot extending the first slot formed in the side wall of the handle means for receiving the stem of a stemmed glass; and wherein said radial opening in said receptacle-forming means extends to the first end of said handle means.

* * * * *